United States Patent [19]

Childress

[11] 3,992,130

[45] Nov. 16, 1976

[54] SUMP PUMP SYSTEM AND PRESSURE RESPONSIVE SWITCH ASSEMBLY THEREFOR

[75] Inventor: Bruce D. Childress, Little Rock, Ark.

[73] Assignee: Jacuzzi Bros. Inc., Little Rock, Ark.

[22] Filed: Dec. 15, 1972

[21] Appl. No.: 315,660

[52] U.S. Cl. ..... 417/36; 417/38; 417/44

[51] Int. Cl.[2] ..... F04B 49/00

[58] Field of Search ..... 417/38, 44, 36; 200/38 A, 38 FB

[56] References Cited

UNITED STATES PATENTS

| | | | |
|---|---|---|---|
| 2,673,901 | 3/1954 | Kountz | 200/38 A |
| 3,091,111 | 5/1963 | Cruse et al. | 417/36 X |
| 3,234,881 | 2/1966 | Ekey | 417/38 |
| 3,656,866 | 4/1972 | Hine, Jr. et al. | 417/38 |
| 3,728,500 | 4/1973 | Ingram | 200/38 FB |

*Primary Examiner*—William L. Freeh
*Assistant Examiner*—G. P. LaPointe

[57] ABSTRACT

A sump pump system includes a remote pressure responsive switch assembly designed for a wall plug and having a plug in connection for the pump motor cord, the pressure responsive switch assembly also having an air pressure connection to the sump pump for actuating the switch in response to a rise in level of water around the pump.

1 Claim, 8 Drawing Figures

SUMP PUMP SYSTEM AND PRESSURE RESPONSIVE SWITCH ASSEMBLY THEREFOR

My invention relates primarily to an appliance such as a sump pump, and more particularly, to a sump pump system and a pressure responsive switch assembly adaptable for use in such system.

In accordance with present practice relating to sump pumps, some sump pumps include a built-in pressure responsive switch which is made responsive to pressure buildup in the pump housing due to rising water, to connect the pump motor in circuit and start the pump.

This practice not only requires considerable precaution and considerable expense on the part of the manufacturer in the matter of sealing the pressure responsive switch against the danger of water entering the switch chamber and creating electrical hazards, but necessitates the venting of the pressure responsive switch from its possible underwater position, and this invariably requires the use of a vented electrical cable or cord, which is a cord having a small diameter venting tube built into it, such cord being quite expensive.

Among the objects of my invention are;

1. To provide a novel and improved sump pump system and pressure responsive switch assembly adaptable therefore;
2. To provide a novel and improved sump pump system which is sensitive to water level;
3. To provide a novel and improved sump pump system which is electrically safe from problems of water contact;
4. To provide a novel and improved sump pump system which avoids the need for a "vented" cord;
5. To provide a novel and improved sump pump system which minimizes sealing problems;
6. To provide a novel and improved pressure responsive switch assembly;
7. To provide a novel and improved pressure responsive switch assembly adaptable for use in a sump pump system;
8. To provide a novel and improved pressure responsive switch assembly of simple and effective construction; and
9. To provide a novel and improved pressure responsive switch assembly adapted to be plugged into a conventional wall outlet.

Additional objects of my invention will be brought out in the following description of a preferred embodiment of the same, taken in conjunction with the accompanying drawings wherein.

Figure 1:
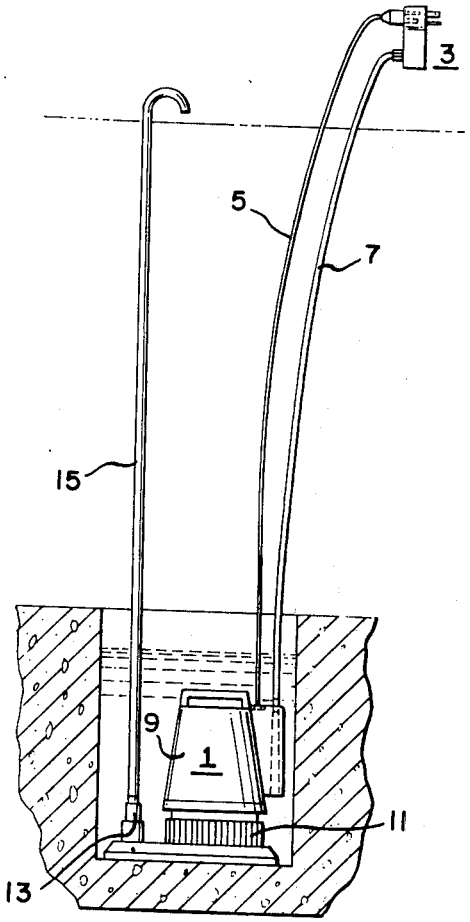
FIG. 1 is a view depicting a sump pump system embodying the present invention.
Figure 6:
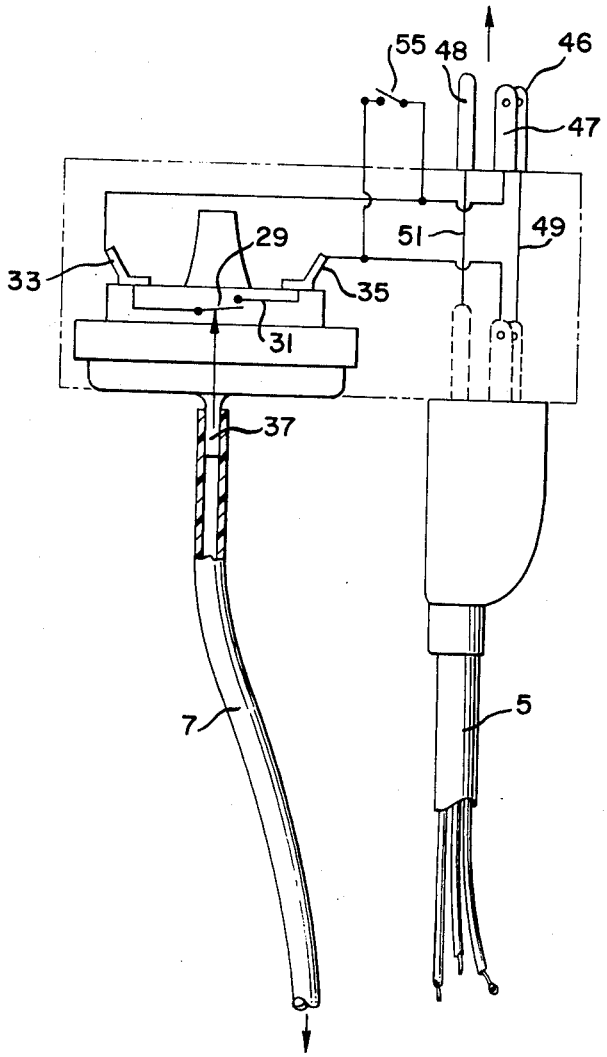
Figure 2A:
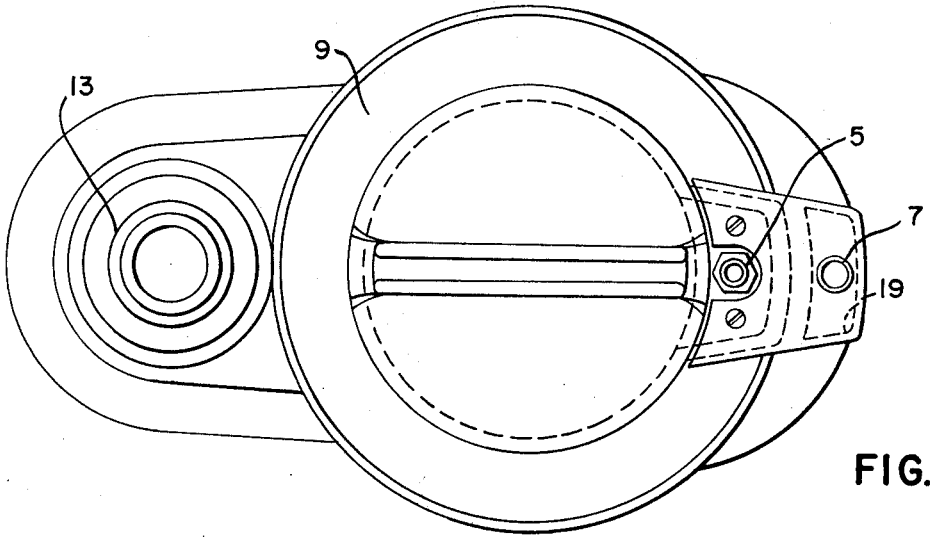
FIG. 2A is a plan view of the sump pump of FIG. 2.
Figure 2:
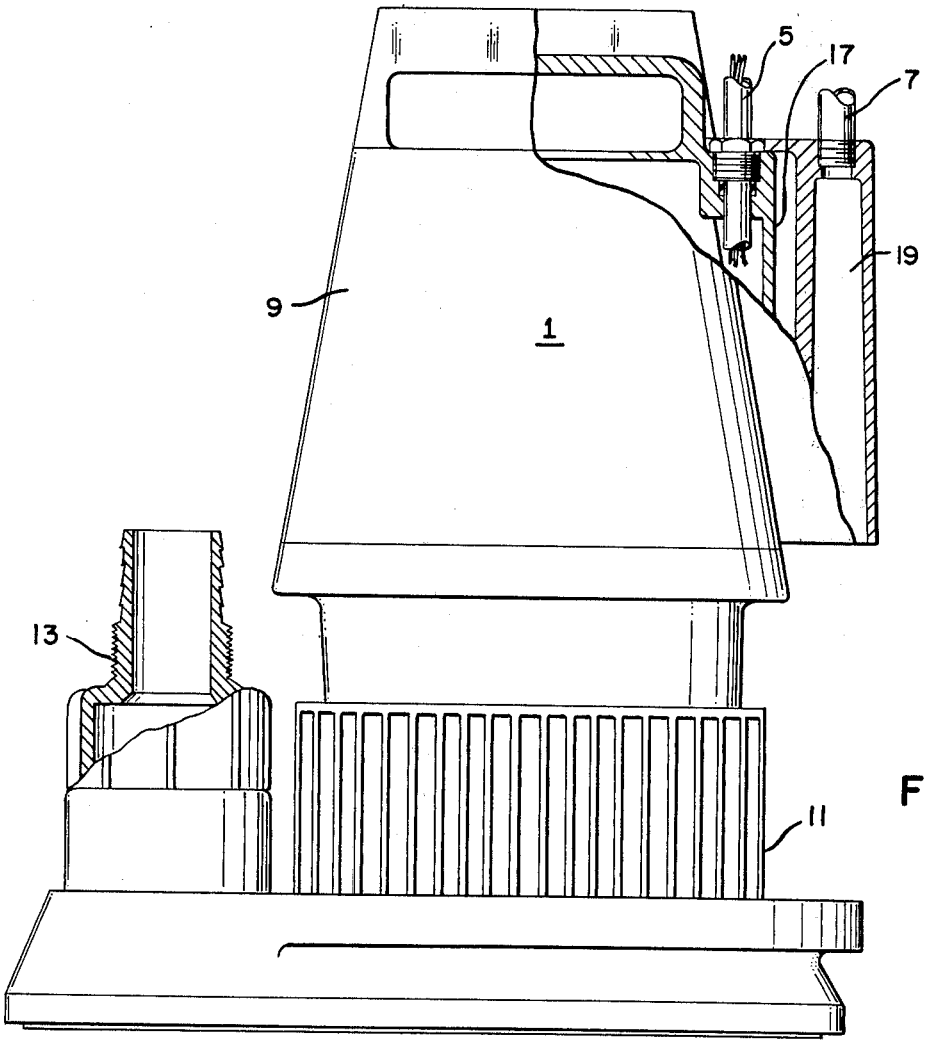
FIG. 2 is a view in elevation of a sump pump, partly broken away to depict electrical and air pressure connections involved in the present invention.
Figure 3:
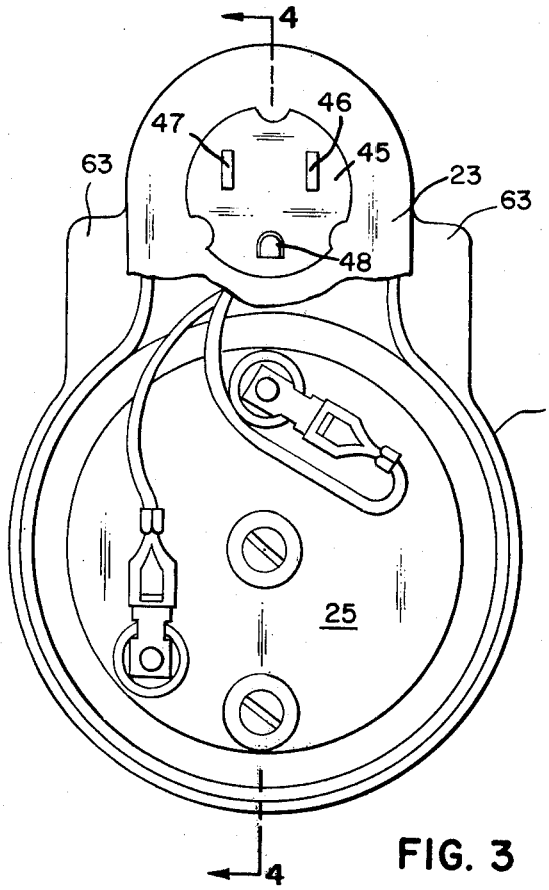
FIG. 3 is an end view of a pressure responsive switch assembly, with cover partly broken away.
Figure 5:
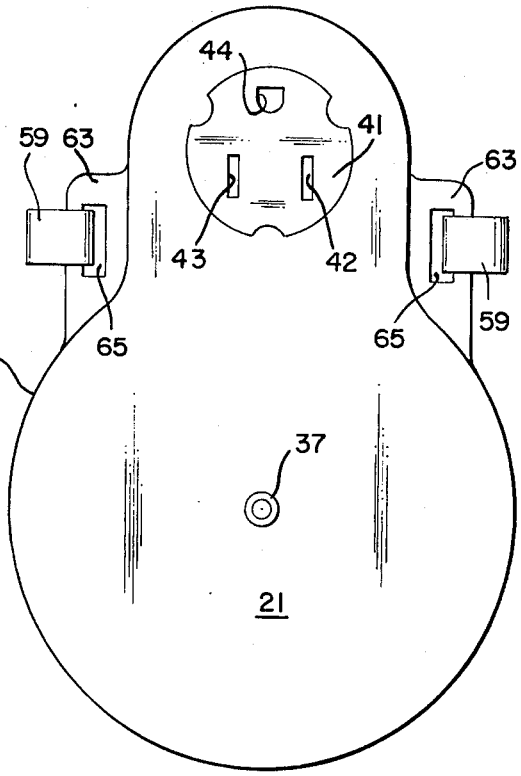
FIG. 5 is an end view, taken opposite to that of FIG. 3.
Figure 4:
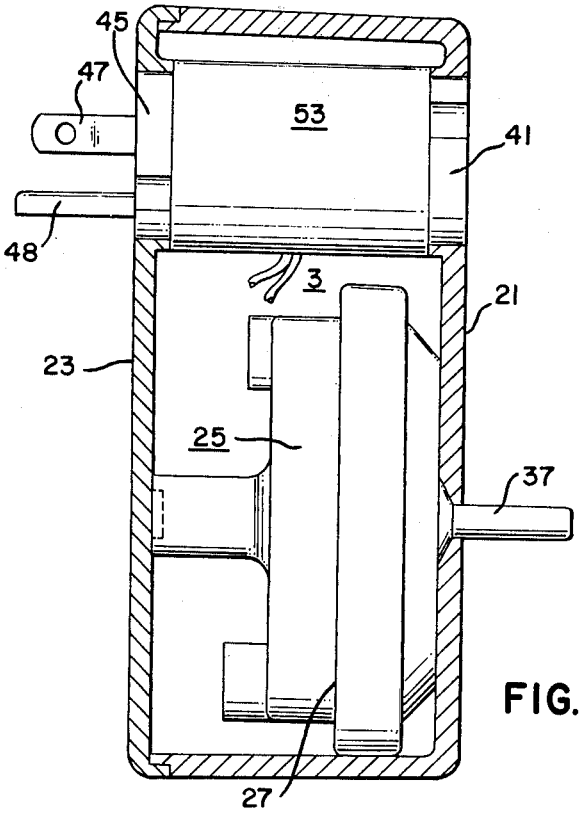
FIG. 4 is a view partly in section taken in the plane 4—4 of FIG. 3.
Figure 5A:
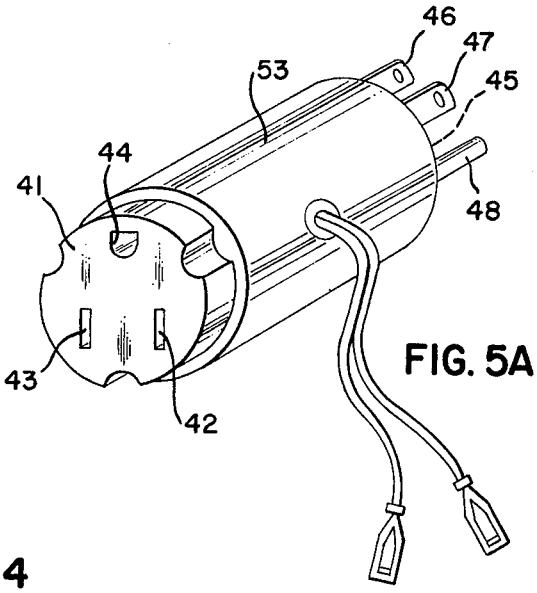
FIG. 5A is a perspective of a sub-assembly component.

Referring to the drawings for details of my invention and its preferred form, the sump pump system illustrated in FIG. 1 involves a sump pump assembly 1 and a pressure responsive switch assembly 3 appropriately interconnected electrically with the sump pump assembly by cable or cord 5, and pressure connected by tubing 7.

The sump pump assembly involves a housing including an upper section 9 providing a motor chamber and a base or pump section 11 which houses the pump impeller, which normally would be mounted on the shaft of the motor to be driven thereby. Discharge from the pump is guided to a fitting 13 which terminates in a hose connection to which a hose line 15 is connected for conducting the discharge to some remote point.

The electrical cord 5 for connecting the pump motor to a source of power, is taken out through an opening in a hollow boss formed in the upper section of the housing, which opening is sealed against intake of moisture.

Mounted on this boss is an air pocket 19 open at its lower end to permit entrance of water, upon rise in level of water about the pump assembly, while at its upper end, the air pocket provides for coupling thereto the tubing 7 to provide a pressure connection to the pressure responsive assembly, it being apparent that as water rises into the air pocket, the air trapped therein will be compressed and develop pressure in the tubing to which the pressure responsive switch assembly 3 will respond.

The air pocket is preferably of substantial volume compared to the diameter of the tubing, whereby the necessary pressure will be developed in response to but a slight rise in elevation of the water within the air pocket, thereby rendering the system sensitive to water level after the water enters the air pocket.

Preferably, the air pocket is installed above the pump section 11 to assure that the pump during periods of operation, will have its bearings entirely submerged in water, whereby they will be water cooled at all times during operation of the pump.

The pressure switch assembly 3 involves a housing comprising a receptacle 21 and a cap 23 fitted thereto. In the housing is installed a pressure switch 25 of any conventional type available on the market.

The one illustrated involves a casing 27 having a pressure responsive diaphram, the movement of which under pressure may be caused to close a pair of normally open contacts 29, 31 electrically connected to exposed terminals 33, 35 respectively for connection in circuit. The casing on the pressure side of the diaphram is provided with a nipple 37 to which may be connected the tubing 7 from the air pocket, whereby compression of air trapped in the air pocket will develop and transmit pressure to the diaphram to close the switch, when the pressure reaches a predetermined value.

Accessible through an opening in the wall of said housing, is a female plug 41 of the electrical type having at least two internal connectors 42, 43 and preferably, in addition, a ground connection 44, and exposed through an opening in an opposite wall of the housing is a male plug 45 of the electrical type having at least two connectors 46, 47 extending through said opening and preferably in addition, a ground connection 48. One of the internal connectors of the female plug is directly connected by a wire 49 to one of the exposed connectors of the male plug, while the other of the internal connectors of the female plug is connected through the pressure switch to the remaining exposed connector of the male plug. If ground connections are provided, the ground connection of the female plug is connected directly to the ground connection of the male plug by a wire 51.

If the wall openings through which the female and male plugs are accessible, are located directly opposite one another, the female and male plugs may be located at the ends of a cylinder 53, which will facilitate the installation of these plugs in the housing.

If desired, a toggle switch 55 or equivalent switch may be shunted across the pressure switch and when so installed, the pressure switch may be cut out of the circuit and rendered ineffective by closing the toggle switch.

With the pressure switch assembly so constructed, it may be plugged into a wall outlet, with the tubing coupled to the nipple of the pressure switch, and the motor cord plugged into the female plug of the pressure switch assembly. When so installed, development of pressure in the air pocket due to a rise in water around the pump will close the pressure switch and apply power to the pump motor.

To facilitate retention of the pressure switch assembly when so plugged in, a clip 59 to receive the assembly may be screwed to the wall below the wall plug. The assembly housing will be provided with suitably located ears 63 having openings 65 therein to receive turned in ends of the clip.

From the foregoing, it will be apparent that by reason of the remote location of the pressure switch the sealing problems which had to be contended with in prior art practice, have now been completely eliminated, at the same time avoiding the necessity of utilizing the relatively expensive vented cord previously required in prior art devices for this purpose.

Further, since the pressure switch assembly is a unit separate and apart from the sump pump assembly itself, any repairs or replacements may be accomplished with the least amount of difficulty, and with no disturbance to the sump pump assembly itself.

While I have illustrated and described my invention in its preferred form, it will be apparent that the same is subject to alteration and modification without departing from the underlying principles involved. As one example, the air pocket may be mounted for vertical adjustment to alter the level at which the pressure switch will function.

I accordingly do not desire to be limited in my protection to the specific details illustrated and described, except as may be necessitated by the appended claims.

I claim:

1. A unitary switch assembly for a sump pump or the like comprising a housing, a pressure switch, a female plug and a male plug in said housing, said female plug having at least two internal connectors accessible through a wall opening of said housing and said male plug having at least two external connectors extending from said housing through an opening in a different wall thereof, whereby said switch assembly may be plugged into a conventional type wall outlet with said internal connectors exposed for connection of an external appliance, a connection from one of said internal connectors to one of said external connectors within said housing, a connection from another of said internal connectors to another of said external connectors within said housing via said pressure switch, means for coupling a source of pressure to said pressure switch, and a clip mountable on a wall of a building below a conventional wall plug and adapted to receive said housing and facilitate retention of said pressure responsive switch assembly when plugged into such wall plug.

* * * * *